US006293102B1

(12) United States Patent
Stay et al.

(10) Patent No.: US 6,293,102 B1
(45) Date of Patent: Sep. 25, 2001

(54) INTEGRAL AIR BRAKE COMPRESSOR SUPPLY FITTING

(75) Inventors: Kevin E. Stay, West Salem, WI (US); Keith D. Agee, Torrance, CA (US)

(73) Assignee: AlliedSignal Inc., Morristown, NJ (US)

( * ) Notice: Subject to any disclaimer, the term of this patent is extended or adjusted under 35 U.S.C. 154(b) by 0 days.

(21) Appl. No.: 09/437,018

(22) Filed: Nov. 9, 1999

Related U.S. Application Data

(60) Provisional application No. 60/108,550, filed on Nov. 16, 1998.

(51) Int. Cl.[7] ..... F02B 33/44
(52) U.S. Cl. ..... 60/605.2; 60/599; 123/563
(58) Field of Search ..... 60/605.2, 599; 123/563

(56) References Cited

U.S. PATENT DOCUMENTS 5,785,030 * 7/1998 Paas ..... 60/605.2
5,806,308 * 9/1998 Khair et al. ..... 60/605.2
5,937,650 * 8/1999 Arnold ..... 60/605.2
5,974,802 * 11/1999 Blake ..... 60/605.2
6,026,791 * 2/2000 Arnold ..... 60/605.2

* cited by examiner

*Primary Examiner*—Thomas Denion
*Assistant Examiner*—Thai-Ba Trieu
(74) *Attorney, Agent, or Firm*—Felix L. Fischer; Samir B. Armaly

(57) ABSTRACT

An air brake compressor supply fitting for an internal combustion engine having a turbocharger and an exhaust gas recirculation (EGR) system is located downstream of the turbocharger and upstream of where the exhaust gas is introduced into the intake air of the engine. The supply fitting can be integrated into an outlet manifold of a charge air cooler (CAC associated with the turbocharger or into an EGR mixer for mixing exhaust gas with the intake air of the engine at a location in the EGR mixer upstream from the location where the exhaust gas is introduced into the intake air of the engine.

5 Claims, 1 Drawing Sheet

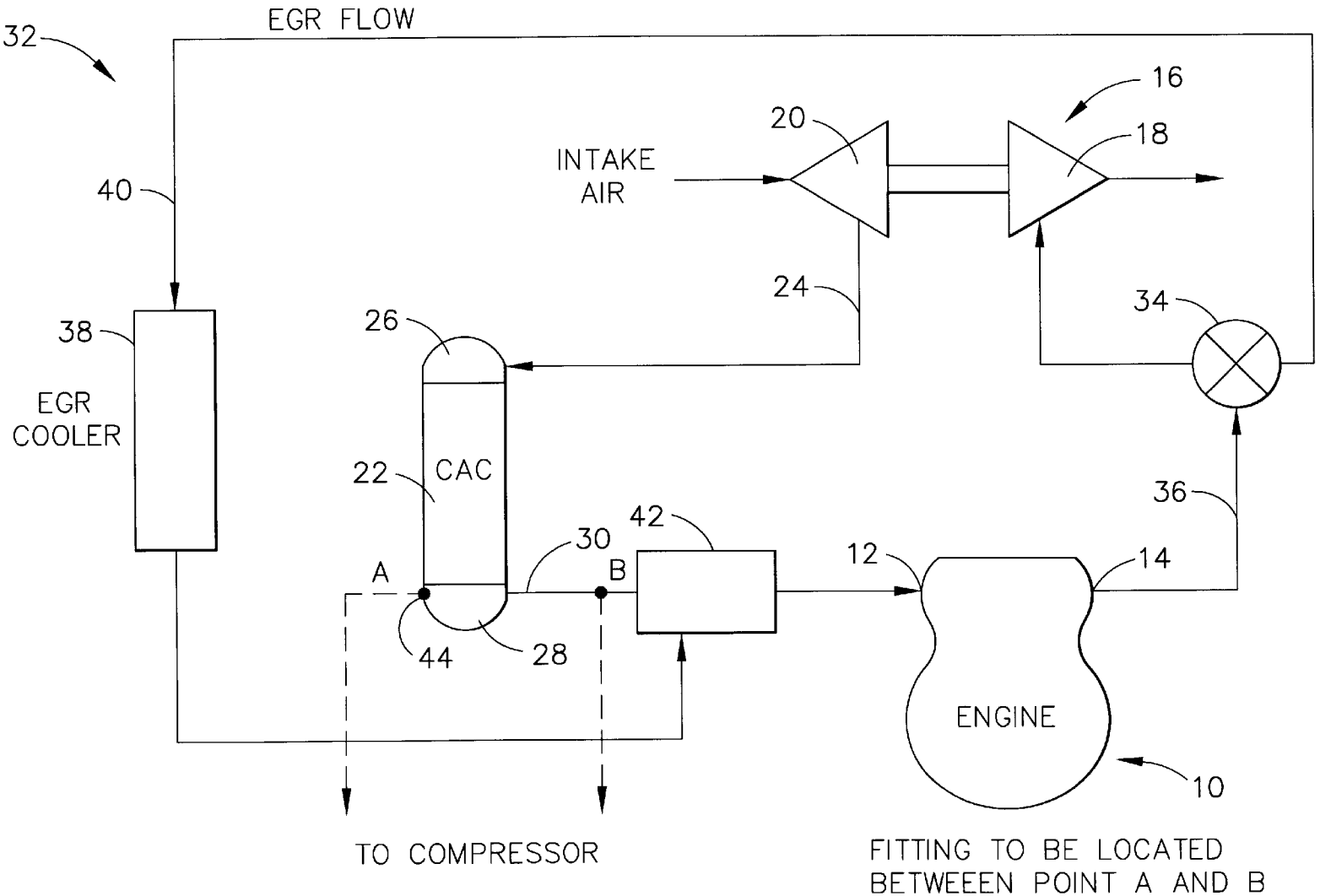
EGR FLOW
INTAKE AIR
CAC
ENGINE
EGR COOLER
TO COMPRESSOR
FITTING TO BE LOCATED BETWEEEN POINT A AND B
A
B
10
12
14
16
18
20
22
24
26
28
30
32
34
36
38
40
42
44

INTEGRAL AIR BRAKE COMPRESSOR SUPPLY FITTING

CROSS REFERENCE TO RELATED APPLICATIONS

This application claims the priority of copending provision application Ser. No. 60/108,550 filed on Nov. 16, 1998 having the same title as the present application.

BACKGROUND OF THE INVENTION

1. Field of the Invention

The present invention relates generally to internal combustion engines having exhaust gas recirculation (EGR) systems, and more particularly, to an internal combustion engine having an EGR system and a integral air brake compressor supply fitting downstream of the turbocharger compressor and upstream of where the exhaust gas is introduced into the EGR mixer.

2. Description of the Related Art

Turbochargers for gasoline and diesel internal combustion engines are known devices used in the art for pressurizing or boosting the intake air stream, which is then routed to a combustion chamber of the engine to improve engine performance. Turbochargers achieve boost by using the heat and volumetric flow of exhaust gas exiting the engine to drive a turbine that in turn powers a compressor for the intake air stream.

Air brakes are also known devices in the braking systems of heavy vehicles. Air brakes require a supply of pressurized air from a compressor to operate. Air brake compressors for heavy vehicles currently receive their air supply from the intake manifold of the internal combustion engine in order to take advantage of the already boosted air pressure. However, in order to meet pending emissions regulations, many engines will require recirculation of the exhaust gas back to the engine intake manifold.

Exhaust gas recirculation (EGR) is a known method for reducing NOx emissions in internal combustion engines. A conventional EGR system comprises a control valve that regulates the amount of exhaust gas that is taken from an engine exhaust manifold and returned to an engine induction system for mixing with the intake air, and subsequent combustion.

For present engine configurations, an EGR system eliminates the intake manifold as a source of clean compressed air. If exhaust gas is allowed to enter the air brake compressor, the compressor will become fouled, seriously affecting brake performance and vehicle safety.

Consequently, a need exists for an improved system that allows the air brake compressors to continue to take advantage of the boosted air pressure, while simultaneously allows for EGR such that the necessary emissions regulations are satisfied.

SUMMARY OF THE INVENTION

The present invention, therefore, provides an air brake compressor supply fitting designed to overcome the disadvantages described above. Specifically, the present invention provides an air brake compressor supply fitting for an internal combustion engine having a turbocharger and an EGR system, wherein the supply fitting is located downstream of the turbocharger and upstream of where the exhaust gas is introduced into the intake air of the engine. In a presently preferred embodiment, the supply fitting is integrally formed into the outlet manifold of the charge air cooler (CAC) or the EGR mixer.

BRIEF DESCRIPTION OF THE DRAWINGS

These an other features and advantages of the present invention will be appreciated as the same become better understood by reference to the following Detailed Description when considered in connection with the accompanying drawings, wherein:

FIG. 1 is a schematic illustration of an internal combustion engine having an EGR system and the air brake compressor supply fitting according to the present invention.

DETAILED DESCRIPTION OF THE INVENTION

Referring now to FIG. 1, the air brake compressor supply fitting according to the present invention is schematically illustrated in an internal combustion engine having a turbocharger and an EGR system.

Engine 10 includes an intake manifold 12 and an exhaust manifold 14. In the illustrated embodiment, the engine includes a tubocharger 16, generally comprising a turbine 18 and a compressor 20, for compressing the intake air of engine 10. The intake air is heated during the turbocharger compression process and must be cooled to satisfy engine durability and performance requirements. That cooling is accomplished by routing the air discharged from the turbocharger 16 to a charger air cooler (CAC) 22 via conventional conduits or ducting 24. The heated intake air discharged from the turbocharger enters the CAC through an inlet manifold 26, where it is cooled by ambient air flowing through the CAC, and then exits through an outlet manifold 28 of the CAC. The intake air is then routed from the CAC to the intake manifold of the engine via conventional conduits or ducting 30.

Engine 10 also includes an EGR system, generally designated as 32. The EGR system includes a control valve 34, located in a conventional conduit or ducting 36 between the exhaust manifold of the engine and the turbocharger, that regulates the proportion of exhaust gas that is taken from the exhaust manifold and either returned to the engine induction system for mixing with the intake air which has passed through the CAC or directed to the turbine of the turbocharger. The control valve 34 routes a portion of the exhaust gas from the exhaust manifold through the EGR system.

In the illustrated embodiment, the EGR system includes an EGR cooler 38 or heat exchanger for cooling the exhaust gas passing through the system. By providing a heat exchanger in the EGR conduit or ducting 40, the efficiency of engine 10 is improved. Other advantages, such as a reduction in NOx and particle emissions and in fuel consumption also result from the presence of the heat exchanger 38. The exhaust gas passing through the heat exchanger 38 is then combined with the intake air passing through the CAC in an EGR mixer 42. The mixture of the intake air and exhaust gas leaves the mixer 42 and enters the intake manifold of the engine.

As noted above, it is desirable to provide the air brake compressors for heavy vehicles with an air supply from the intake air of the engine 10 in order to take advantage of the already boosted air pressure resulting from the turbocharger compression process. Typically, compressed air is taken from the intake manifold of the engine. However, the intake manifold is eliminated as a source of clean compressed air due to the presence of the EGR system. Therefore, an air brake compressor supply fitting 44*a* is provided in the system to direct clean air to the air brake compressor (not shown) through conduit 46*a*. In order to allow the air brake compressor to receive clean, compressed air, the supply fitting must be located downstream of the turbocharger and upstream of where the exhaust gas is introduced into the EGR mixer.

In one embodiment, the supply fitting 44*a* is integrated into the outlet manifold of the CAC (at point A in FIG. 1). Alternatively, the supply fitting 44*b* may be integrated into the EGR mixer, upstream of the inlet of the EGR mixer where the exhaust gas is introduced (at point B in FIG. 1) to provide air through conduit 46*b*. Since the outlet manifold of the CAC and the EGR mixer are likely to be castings, they could easily and cost effectively accept the fitting for the brake compressor supply air.

The supply fitting may alternatively be incorporated into part of the ducting or conduits between the CAC and the EGR mixer, or in an elbow connection between sections of the ducting. For example, the supply fitting may be located in cast or formed rubber elbows in the engine intake line between the CAC and the EGR mixer. In the case of rubber elbows, the fitting would be molded into the rubber. Alternatively, the fitting may be located in rubber hose connections between duct sections. Again, the fitting would be molded into the rubber.

Having now described the invention in detail as required by the patent statutes, those skilled in the art will recognize modifications and substitutions to the specific embodiments disclosed herein. Such modifications are within the scope and intent of the present invention.

What is claimed is:

1. A source supplying intake air to an air brake compressor for an engine comprising:

a turbocharger for turbocharging intake air of the engine;

a conduit connected to the turbocharger and an intake manifold of the engine;

an exhaust gas recirculation (EGR) system having an exhaust gas introduction point in the conduit; and a supply fitting operable engaged to the conduit and located downstream of the turbocharger and upstream of the exhaust gas introduction point into the intake air of the engine.

2. The air brake compressor supply source as defined in claim 1, wherein the conduit further includes a charge air cooler (CAC) having an outlet manifold, and wherein the supply fitting is located in the outlet manifold of the CAC.

3. The air brake compressor supply source as defined in claim 2, wherein the supply fitting is integrated into the outlet manifold of the CAC.

4. The air brake compressor supply source as defined in claim 1, wherein the EGR system includes an EGR mixer including the introduction point for mixing exhaust gas with the intake air of the engine, and wherein the supply fitting is operable attached to the EGR mixer, upstream from the exhaust gas introduction point.

5. The air brake compressor supply source as defined in claim 4, wherein the supply fitting is integrated into the EGR mixer.

* * * * *